US007624877B2

(12) United States Patent
Bourke

(10) Patent No.: US 7,624,877 B2
(45) Date of Patent: Dec. 1, 2009

(54) SEPARATE SIZE FLOTATION DEVICE

(75) Inventor: Peter Gerard Bourke, Western Australia (AU)

(73) Assignee: Outotec Oyj, Espoo (FI)

( * ) Notice: Subject to any disclaimer, the term of this patent is extended or adjusted under 35 U.S.C. 154(b) by 993 days.

(21) Appl. No.: 10/549,724

(22) PCT Filed: Mar. 16, 2004

(86) PCT No.: PCT/AU2004/000316

§ 371 (c)(1),
(2), (4) Date: Sep. 16, 2005

(87) PCT Pub. No.: WO2004/082842

PCT Pub. Date: Sep. 30, 2004

(65) Prior Publication Data

US 2006/0219603 A1 Oct. 5, 2006

(30) Foreign Application Priority Data

Mar. 17, 2003 (AU) ..... 2003901208

(51) Int. Cl.
*B03D 1/02* (2006.01)
*B03D 1/16* (2006.01)
*B03D 1/22* (2006.01)

(52) U.S. Cl. ..... 209/164; 209/169

(58) Field of Classification Search ..... 209/164, 209/169

See application file for complete search history.

(56) References Cited

U.S. PATENT DOCUMENTS 4,612,113 A 9/1986 Kallioinen
5,205,926 A 4/1993 Lawrence (Continued)

FOREIGN PATENT DOCUMENTS

CL 34817 1/1985

(Continued)

OTHER PUBLICATIONS

English Abstract of SU 1563582.

(Continued)

*Primary Examiner*—Thomas M Lithgow
(74) *Attorney, Agent, or Firm*—Darby & Darby P.C.

(57) ABSTRACT

The invention provides a flotation device including a series of flotation tanks (1) for processing a slurry incorporating valuable minerals for extraction. At least one of the tanks includes a side outlet (15) adapted for the withdrawal of targeted relatively fine coarse particles from the slurry. The tanks also include a bottom outlet (14) for the withdrawal of relatively dense or coarse components of the slurry. The incorporation of bottom and side outlets allows the slurry to be separated into two parallel streams, one configured for optimal recovery of the relatively coarse or dense slurry components and the other for optimal recovery of the relatively fine slurry components. In this way, outflow slurry from downstream tanks in the coarse particle stream has a higher proportion of coarser particles than was present in the inflow slurry from the upstream tanks. Consequently, when a flotation reagent is added to the slurry in the downstream tanks, there is a greater probability of coating some of the larger particles. Therefore, the probability of floating these larger particles increases in the downstream tanks. This in turn increases the overall efficiency of the flotation process.

48 Claims, 3 Drawing Sheets

U.S. PATENT DOCUMENTS

| | | | | |
|---|---|---|---|---|
| 5,219,467 | A | | 6/1993 | Nyman et al. |
| 5,601,703 | A | * | 2/1997 | Szymocha et al. ..... 209/164 |
| 5,909,022 | A | | 6/1999 | Bourke et al. |
| 5,923,012 | A | | 7/1999 | Bourke et al. |
| 5,979,665 | A | | 11/1999 | Serres |

FOREIGN PATENT DOCUMENTS

| | | |
|---|---|---|
| GB | 633776 | 12/1949 |
| RU | 2053028 | 1/1996 |
| RU | 2177370 | 12/2001 |
| SU | 439316 | 8/1974 |
| SU | 604466 | 4/1978 |
| SU | 1512475 | 9/1989 |
| SU | 1563582 | 5/1990 |
| SU | 1623766 | 1/1991 |
| SU | 1806017 | 3/1993 |

OTHER PUBLICATIONS

English Abstract of SU 1512475.
English Abstract of SU 1623766.
English Abstract of RU 2177370.
English Abstract of RU 2053028.
European Search Report EP 04720833.5 (PCT/AU2004/000316) mailed on Jun. 1, 2007.

* cited by examiner

SEPARATE SIZE FLOTATION DEVICE

This application is the national phase application under 35 U.S.C. §371 of International Application No. PCT/AU2004/0003 16 filed on Mar. 16, 2004, entitled, "A SEPARATE SIZE FLOTATION DEVICE" which claims the benefit of Australian Patent Application No. 2003901208 filed on Mar. 17, 2003.

FIELD OF THE INVENTION

The present invention relates to flotation devices of the type used in mineral separation and will be described hereinafter with reference to this application. However, it will be appreciated that the invention is not limited to this particular field of use.

BACKGROUND OF THE INVENTION

The following discussion of the prior art is intended to place the invention in an appropriate technical context and to allow its benefits to be fully appreciated. Any statements about the prior art should not, however, be considered as admissions that such prior art is widely known or forms part of common general knowledge in the field.

Conventional flotation devices typically include a tank for receiving and containing slurry from a grinding mill, cyclone separator, or the like. An agitator, comprising a rotor housed within a stator, is normally disposed within the tank, and activated via a motor and drive shaft to agitate the slurry. An aeration system is also provided to direct air under pressure into the agitator through a central conduit formed within the drive shaft. Suitable reagents are also added, which coat the surfaces of the mineral particles within the slurry to make the particles hydrophobic and thereby to preferentially promote bubble to particle attachment. As bubbles dispersed by the rotor rise toward the surface of the tank, they carry with them floatable valuable mineral particles, which form a mineral enriched surface froth. The froth then migrates over a lip and into a launder whereby the valuable mineral particles suspended in the froth are recovered from the tank as a mineral concentrate. The gangue particles remaining suspended in the slurry, along with those mineral particles that were not removed by flotation, are continuously discharged from the tank through a bottom outlet. The bottom outlet often incorporates a dart or pinch valve, which is opened to allow the remaining slurry to progress under gravity feed to downstream treatment processes. It is normal practice to control the pulp level in each device using a PID controller, a level indicating probe and a control valve in the form of a dart, pinch or other suitable type of valve.

The slurry that is transferred through the bottom outlet includes both relatively coarse or dense particles as well as a large number of relatively fine particles, including gangue slimes such as clay minerals, not removed by flotation. The slimes consist of very fine particles and accordingly have a total surface area much greater than that of the coarse particles. Accordingly, when a flotation reagent is added to the outflow from the tank, the majority tends to be absorbed by the slimes, which are not floatable, making the flotation process non-selective. Consequently, most of the coarser valuable particles do not receive sufficient flotation reagent to make them hydrophobic, even given extended conditioning times.

The flotation process can be made more efficient where coarse and fine particles are treated separately and in the past, devices such as hydrocyclones and hydrosizers have been used to separate a flotation feed stream into two discrete streams for separate processing. However, the capital cost of this equipment is high, making the prior art methods uneconomical for all but the most valuable ore bodies.

It is an object of the present invention to overcome or substantially ameliorate one or more disadvantages of the prior art, or at least to provide a useful alternative.

SUMMARY OF THE INVENTION

Accordingly, a first aspect of the present invention provides a flotation device including:

an upstream tank to contain slurry incorporating fine and coarse particles containing minerals to be extracted;

a feed inlet for admission of slurry into the upstream tank;

agitation means to agitate the slurry within the upstream tank;

aeration means to aerate the slurry within the upstream tank, whereby floatable minerals in suspension float upwardly to form a surface froth for removal via an overflow launder;

a bottom outlet for withdrawal of relatively coarse or dense components of the slurry from the upstream tank, the bottom outlet directing the relatively coarse or dense components of the slurry into a downstream tank configured for optimal treatment of a slurry including a relatively high proportion of relatively coarse or dense components; and a side outlet for withdrawal of relatively fine or lower density components of the slurry from the tank.

Preferably, the side outlet is adapted to remove slurry containing a relatively high proportion of gangue slimes from the top half of the tank, between a mixing zone of the motor and a froth zone near the tank surface. More preferably, the side outlet is adapted to remove slurry from the top third of the tank.

Preferably, the side outlet includes a fluid conduit extending inwardly from the tank sidewall. In one embodiment, the conduit terminates near the centre of the tank, generally proximal a vertical axis of the tank.

In one embodiment, the side outlet directs the lower density components to a separate slurry processing unit configured for optimal treatment of relatively fine particles.

Preferably, the flotation device includes a top substantially hollow deflection cone fixed with respect to the tank and extending generally around the drive shaft. More preferably, the fluid conduit extends through a sidewall of the cone to facilitate fluid transfer from within the top cone, to the side outlet.

Preferably, the flotation device additionally includes a bottom substantially hollow deflection cone, also extending generally around the drive shaft, at a position below the top cone. More preferably, the bottom cone is axially movable relative to the drive shaft to allow the area of an annular opening between the cones to be adjusted. Preferably, in one selected configuration, the lower end of the top cone is nested at least partially within the upper end of the bottom cone.

Preferably, the top cone is truncated and includes an opening at its lowermost end. Preferably also, the lowermost end of the bottom cone fits relatively closely around the drive shaft, substantially to prohibit slurry flow through a region between the lowermost end of the bottom cone and the drive shaft.

Preferably, the agitation means includes a rotor supported for rotation within a surrounding stator, and operable by means of a central drive shaft extending downwardly into the tank.

The aeration means preferably includes an air blower and a fluid conduit for directing air from the blower into the agitator. The conduit preferably includes an axial bore extending through the drive shaft of the rotor.

The tank is preferably right cylindrical and the bottom outlet is defined by an opening in the lower half of the tank. Preferably, the opening is in the tank sidewall adjacent the tank floor. Alternatively, the bottom outlet is in the tank floor adjacent the tank sidewall. In another embodiment, a lower portion of the tank is conical in shape such that the relatively dense and coarse components of the slurry are directed toward the bottom outlet upon settling from solution or suspension.

Preferably, the device includes a plurality of tanks, each having an inlet connected to the outlet of its adjacent upstream tank. In one embodiment, all of the tanks are substantially identical, with each tank including a side outlet for withdrawal of relatively lower density components of the slurry from the tank. Preferably, each side outlet directs the lower density components to a separate slurry processing unit configured for optimal treatment of relatively fine particles. Alternatively, only the third and subsequent tanks in the series include a side outlet.

Preferably, the plurality of tanks is arranged in pairs. More preferably, the level of the base of each successive tank pair is lower than the base of its adjacent upstream pair, such that slurry flows under the influence of gravity from one tank pair to the next. Alternatively, the tanks are arranged in groups of more than two, wherein the level of the base of each successive tank group is lower than the base of the adjacent upstream group, such that slurry flows under the influence of gravity from one tank group to the next.

Preferably, the outlet from one tank pair to the adjacent downstream tank pair includes a valve to allow discharge of the relatively coarse or dense components of the slurry. More preferably, the valve is a dart valve or pinch valve, which may be positioned substantially within the tank adjacent the outlet, or in a conduit extending between adjoining tanks.

In the preferred embodiment of the invention, mineralised froth migrating across the overflow lip is collected in an overflow launder for recovery and further concentration.

A second aspect of the invention provides a method of separate size flotation in a flotation device, the method including the steps of:

providing a tank to contain slurry incorporating minerals to be extracted;

directing feed slurry into the tank;

agitating the slurry within the tank;

aerating the slurry whereby floatable minerals in suspension form a surface froth;

removing the froth via a launder system;

separately withdrawing relatively coarse or dense and relatively fine or lower density components of the slurry from the tank for separate downstream treatment.

Preferably, after withdrawal from the tank, the relatively fine or lower density components are directed into one or more downstream fine particle flotation tanks specifically configured for optimal recovery of relatively fine particles. Alternatively, where the fine particles are predominantly gangue slimes, they may simply be discarded.

Preferably, after withdrawal from the tank, the relatively coarse or dense components are directed into a separate series of one or more downstream coarse particle flotation tanks. More preferably, the above process is repeated in the downstream tanks.

Preferably, the method includes the step of adding a flotation reagent to the slurry in the downstream tanks.

Preferably, the method includes the step of adequately diluting the slurry in the downstream tanks.

BRIEF DESCRIPTION OF THE DRAWINGS

A preferred embodiment of the invention will now be described, by way of example only, with reference to the accompanying drawings in which.

PREFERRED EMBODIMENTS OF THE INVENTION

Figure 1:
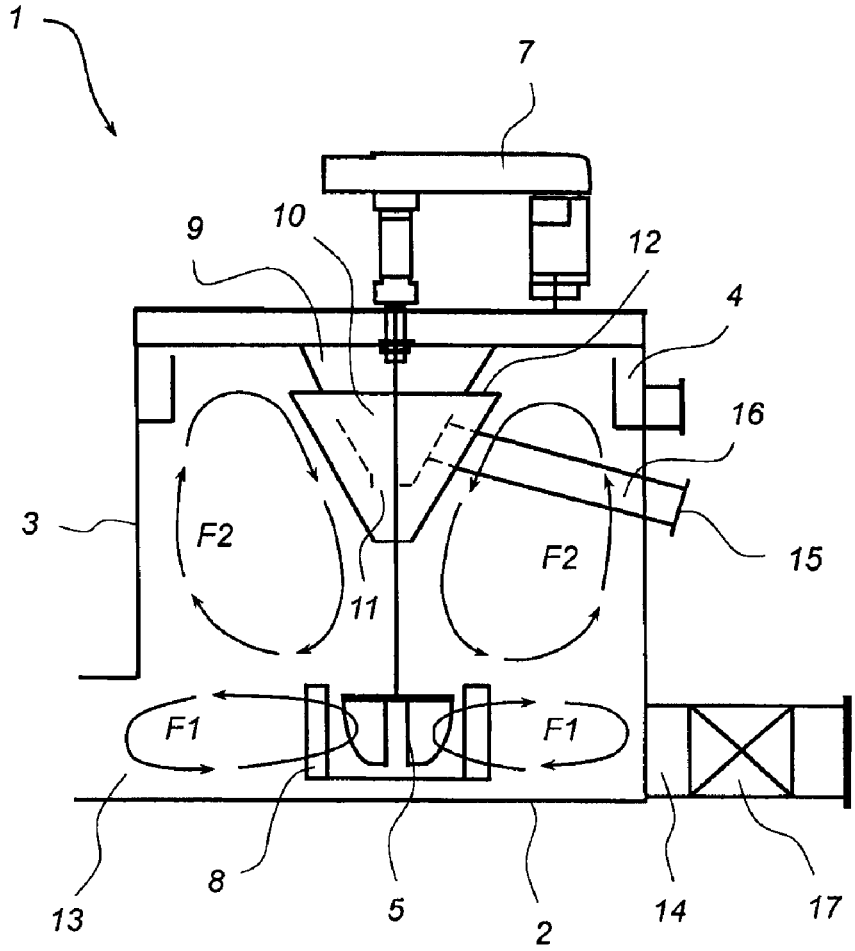
FIG. 1 is a diagrammatic cross-sectional side elevation showing a flotation device according to the invention.

The illustrated flotation device is adapted for use in extracting valuable minerals from the cyclone overflow from a grinding circuit. This overflow is in the form of a slurry and typically includes mineral particles having a P80 of between around 50 μm to around 220 μm. However, the slurry also contains gangue slimes, which contain few recoverable valuable minerals, but which tend to absorb a high proportion of flotation reagents that are added to the slurry to facilitate recovery of the valuable minerals. It is emphasised that the illustrated flotation device differs from other flotation devices, such as flash flotation cells or "Skim Air" cells, which are typically located upstream in the grinding mill circuit and are used to process slurries containing much coarser particles and also having a higher percentage of solids. Typically, Skim Air cells are used to process slurries containing around 65% solids, whereas the illustrated flotation device is configured to process slurries with up to around 50% to 55% solids. It is also noted that Skim Air cells are configured to cause around 70% to 80% of the solids to bypass the rotor. This 70% to 80% of solids contains most of the coarse material from the feed slurry, which if fed into the rotor causes significant rotor wear. However, in conventional cells, such as those shown in the drawings, the feed slurry contains much smaller particles, and accordingly, the slurry is caused to pass directly through the rotor.

Referring to the drawings, the invention provides a flotation device including a tank 1 containing a slurry incorporating minerals to be extracted. Typically, the tank would have a capacity of at least 100 $m^3$, however in some alternative embodiments, smaller tanks are used. The tank includes a generally flat base 2 and a substantially cylindrical sidewall 3 extending upwardly from the base. A peripheral overflow launder 4 extends around the inside top of the sidewall for removing mineral enriched froth as it floats to the surface.

An agitator is disposed to agitate the slurry within the tank. The agitator includes a rotor 5 mounted on a centrally disposed drive shaft 6 extending axially downwardly into the tank and driven by a motor 7. A stator 8 is also provided around the rotor. As shown in the drawings, the rotor is located close to the floor of the tank, such that when feed slurry enters the tank it flows directly through the rotor.

Axially spaced top and bottom hollow froth deflection cones 9 and 10 are also provided. The cone sidewalls extend around the drive shaft adjacent the top of the tank and each cone is oriented such that its smallest diameter is located at its lowermost end nearest the rotor 5. The top cone 9 is truncated and includes an opening 11 at its lowermost end. However, the lowermost end 12 of the bottom cone fits relatively closely around the drive shaft 6, substantially to prohibit slurry flow through this region.

The top cone is fixed with respect to the tank and the lower cone 10 is axially movable along the drive shaft 6 to allow the area of an annular opening 12 between the partially nested cones to be adjusted. In use, the lower cone 10 is moved toward the rotor 5 to increase the area of the opening or away from the rotor to reduce the area of the opening 12.

The flotation device further includes an aeration system including an air blower and a fluid conduit (not shown) to direct air from the blower into the agitator. The conduit is defined in part by an axial bore (not shown) extending through the drive shaft 6 of the rotor.

Feed slurry is introduced into the tank 1 through a feed inlet 13 formed in the sidewall of the tank. A bottom outlet 14 is formed in the lower portion of the tank sidewall 3 to allow removal of relatively coarse or dense components of the slurry. A side outlet 15 is provided to remove slurry containing a relatively high proportion of the gangue slimes for separate downstream treatment. The side outlet includes a fluid conduit 16 connected to the top cone 9. The conduit passes through a slot (not shown) in the sidewall of the bottom cone. A flexible seal (not shown) is provided around the conduit 16 to seal the slot. The conduit is located in the top third of the tank and is adapted to remove slurry from within the top deflection cone 9. The side outlet also includes a valve (not shown) to control flow of fluid from the top cone. The valve can be a pinch valve, or may be a weir type arrangement, or any other suitable alternative.

As will be appreciated by those skilled in the art, particle size distribution varies within the tank based on the initial composition of the slurry, and relevant system parameters such as tank geometry, aeration rate and the normal operating speed of the agitator. Moreover, it is known that the gangue slimes present in the slurry do not float, despite the fact that they absorb a significant amount of the flotation reagents added to the slurry to facilitate recovery of the valuable mineral particles. Accordingly, the size and location of the opening 12 between the deflection cones is adjusted on the basis of these parameters and the flotation kinetics of the gangue slimes to correspond with a position within the tank having a relatively high concentration of gangue slimes. This position is above a mixing zone of the rotor and below a froth zone near the top of the tank. Adjusting the area of the opening controls the fluid velocity through the opening, and hence the size range of particles entering the bottom cone 10. In this way, the system can be optimised to remove a majority of the gangue slimes through the side outlet without loss of valuable minerals.

Turning now to describe the operation of the flotation device in more detail, slurry is initially fed into the tank via feed inlet 13, from where it migrates toward the agitation and aeration assemblies positioned near the bottom of the tank. The action of the rotor 5 induces a primary flow through the slurry as indicated by arrows F1. The primary flow continuously recirculates the slurry at the bottom of the tank to maintain the particles in suspension. The aeration system continuously disperses air into the rotor 5 to form fine bubbles which collide with and adhere to the valuable mineral particles in the slurry and subsequently float to the top of the tank to form a mineral enriched surface froth. As the froth floats toward the surface, it is directed radially outwardly by the deflection cones for recovery through the overflow launder 4. The rotor also induces a secondary flow through the slurry as indicated by arrows F2.

As targeted finer particles move in the direction indicated by arrows F2, they are drawn into the opening 12 between the deflection cones. From there, they pass downwardly through the bottom cone 10, up through the opening 11 in the top cone, through conduit 16 and out through the side outlet 15. The fine particles are processed downstream separately from the outflow from the bottom outlet 14. Simultaneously, due to their buoyancy and upward velocity, valuable mineral particles which have become attached to bubbles from the aeration system rise into the froth zone near the top of the tank for recovery via the overflow launder.

Any gangue particles remaining suspended in the slurry, along with those mineral particles that were not removed by flotation, are continuously discharged from the tank through the bottom outlet 14. From there, the coarse particles are directed initially into a second tank that is substantially identical to the first tank.

Figure 2:
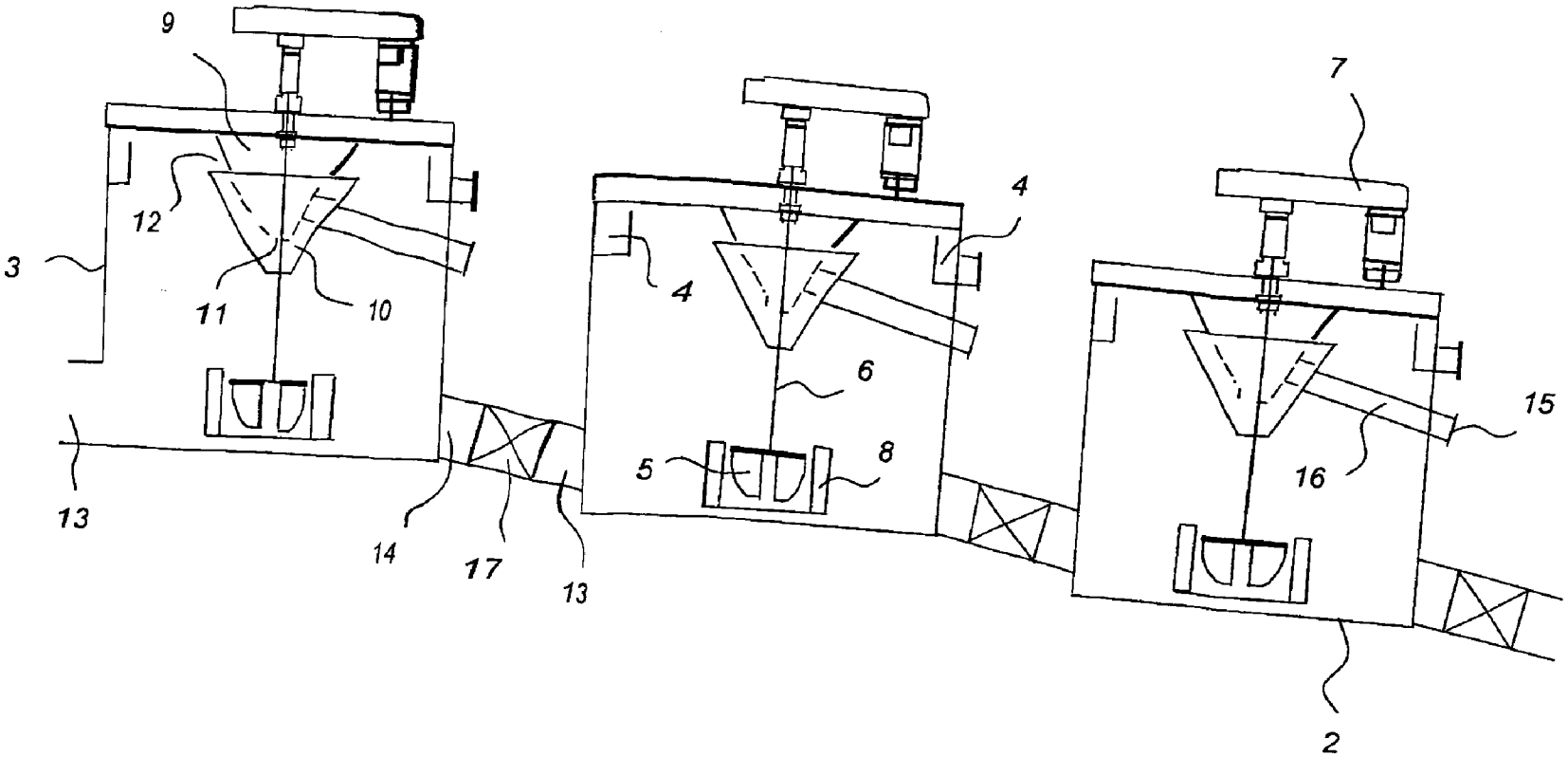
FIG. 2 is a schematic view showing a network of the flotation devices.

In the embodiment illustrated in FIG. 2, this second tank includes a base 2 located at a lower level than the base of the first tank such that slurry feeds into the second tank under gravity. From the second tank, the slurry flows under gravity into a plurality of substantially similar downstream tanks, each connected in series. Respective dart valves 17 control flow of slurry between adjacent tanks.

Figure 3:
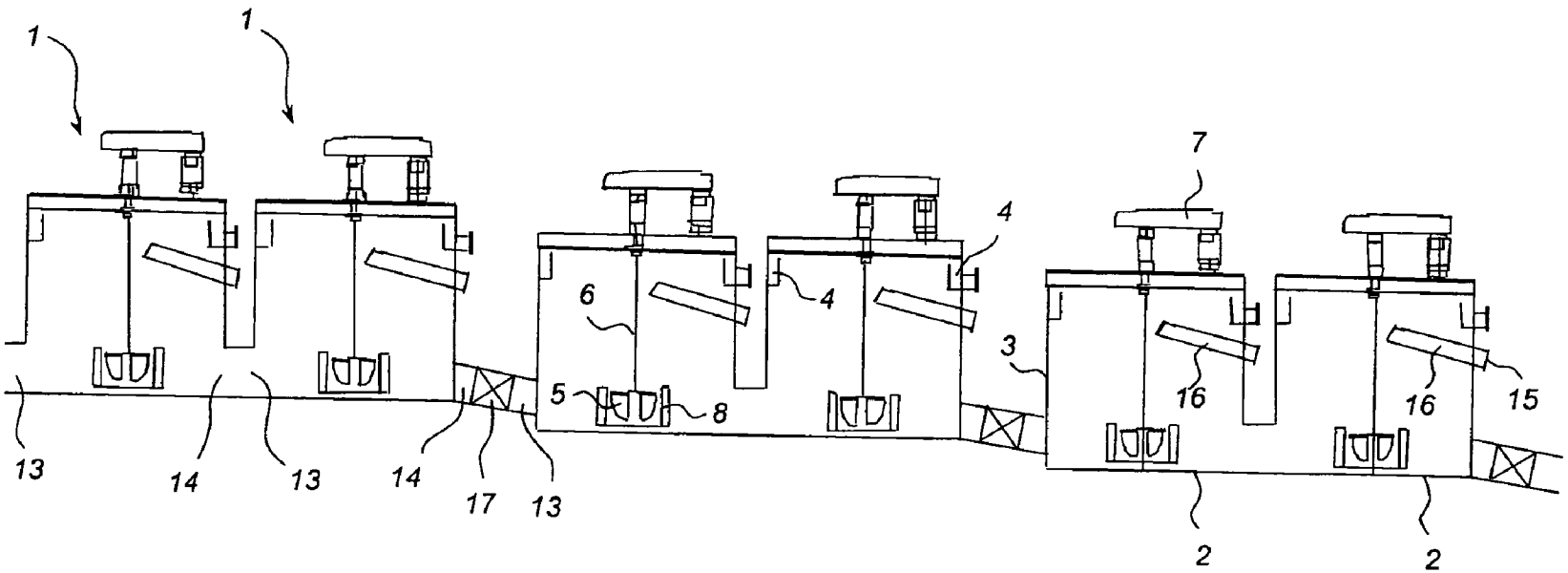
FIG. 3 is a schematic view of an alternative network arrangement.

In the embodiment illustrated in FIG. 3, the second tank is located at the same level, such that the first and second tanks define a first tank pair. From the second tank, the slurry flows under the influence of gravity into a plurality of downstream tank pairs, each substantially identical to the first pair. Flow of slurry between the tank pairs is controlled by respective dart valves 17, which are continuously adjusted to maintain the pulp level in the cell. As shown in FIG. 3, the base of each subsequent tank pair is lower than that of the adjacent upstream tank pair.

It will be appreciated that in alternative embodiments, the tanks may be disposed at the same level and the slurry may be pumped between the tanks. Also, in some situations, it may be preferable to include side outlets on only some of the downstream tanks. It will also be appreciated that hybrid and other network combinations, including tanks connected in series, parallel or a combination of both, may be employed, as required. It will further be understood that different valve types, and different forms of conduit between the tanks, may alternatively be used. In still further embodiments, the aeration system may supply air to the rotor through a pipe with a discharge point located underneath the rotor. In yet another embodiment, such as that illustrated in FIG. 3, the deflection cones are omitted and the conduit 16 extends from the side outlet 15 to terminate at a position in the top third of the tank, near the drive shaft 6.

In the illustrated embodiments, it will be appreciated that the outflow slurry from each tank has a higher proportion of coarser particles than was present in the inflow slurry from the upstream tanks, since some of the finer particles are removed through the side outlets 15. Accordingly, the proportion of coarse particles in the slurry increases as the feed liquid migrates progressively through the network of tanks. Consequently, when a flotation reagent is added to the slurry in the downstream tanks, there is a greater probability of coating some of the larger particles. Therefore, the probability of floating these larger particles increases in the downstream tanks. This in turn increases the overall efficiency of the flotation process.

As described above, the flotation device permits a slurry stream containing both fine and coarse particles to be separated progressively into two parallel branches, with one branch containing the relatively coarse particles from the stream and the other branch containing the finer particles. In this way, the two branches can be individually optimised for the treatment of either coarse or fine particles, which optimises the efficiency and cost effectiveness of the overall separation process. It will therefore be appreciated that the invention provides both practical and commercially significant advantages over the prior art.

While the invention has been described with reference to conventional flotation cells, it will be appreciated that the same principles may be applied to other flotation cells, such as flash flotation cells, or Skim Air cells. Moreover, although the invention has been described with reference to specific examples, it will be appreciated by those skilled in the art that the invention may be embodied in many other forms.

The invention claimed is:

1. A flotation device including:

a sequence of at least two flotation tanks arranged relatively as an upstream tank and a downstream tank, each of said tanks being adapted to receive slurry incorporating fine and coarse particles containing minerals to be extracted, and each of said tanks including:

a feed inlet for admission of slurry;

agitation means to agitate the slurry;

aeration means to aerate the slurry whereby floatable minerals in suspension float upwardly to form a surface froth;

an overflow launder for removal of the surface froth; and a bottom outlet for withdrawal of relatively coarse or dense components of the slurry;

wherein the bottom outlet from the upstream tank is connected to the feed inlet of the downstream tank whereby a relatively dense fraction of the slurry including a relatively high proportion of coarse or dense components is withdrawn from the upstream tank and fed directly to the downstream tank for reprocessing in the downstream tank; and wherein at least one of said tanks includes an upper side outlet adapted for withdrawal of a relatively fine fraction of the slurry including a relatively high proportion of fine or lower density components for separate size processing independently of the upstream and downstream tanks.

2. A flotation device according to claim 1, comprising a sequence of three or more of said tanks connected in series, with the bottom outlet of each tank save for the last being connected to the feed inlet of the tank immediately downstream.

3. A flotation device according to claim 1, wherein each of said tanks includes a respective upper side outlet.

4. A flotation device according to claim 1, wherein each of said tanks includes a substantially flat base and wherein the bottom outlet of each tank is formed in a sidewall of the tank adjacent the base.

5. A flotation device according to claim 1, wherein at least one of said side outlets is adapted to remove slurry containing a relatively high proportion of gangue shines from the top half of the tank.

6. A flotation device according to claim 1, wherein at least one of said side outlets is adapted to remove slurry containing a relatively high proportion of gangue shines from between a mixing zone of the rotor and a froth zone near the tank surface.

7. A flotation device according to claim 1, wherein at least one of said side outlets is adapted to remove slurry from the top third of the tank.

8. A flotation device according to claim 1, wherein at least one of said side outlets includes a fluid conduit extending inwardly from the tank sidewall.

9. A flotation device according to claim 8, wherein the conduit terminates near the centre of the respective tank, generally proximal a vertical axis thereof.

10. A flotation device according to claim 1, wherein at least one of said side outlets directs the lower density components to a separate slurry processing unit configured for optimal treatment of relatively fine particles.

11. A flotation device according to claim 1, wherein at least one of said tanks further includes a top substantially hollow deflection cone fixed with respect to the tank and extending generally around the drive shaft.

12. A flotation device according to claim 11, wherein at least one of said tanks further includes a fluid conduit extending through a sidewall of the top cone to the respective side outlet to facilitate fluid transfer from within the top cone to the side outlet.

13. A flotation device according to claim 11, wherein a corresponding at least one of said tanks further includes a bottom substantially hollow deflection cone, also extending generally around the drive shaft, at a position below the top cone.

14. A flotation device according to claim 13, wherein the bottom cone is axially movable relative to the drive shaft to allow an area of an annular opening between the top and bottom cones to be selectively adjusted.

15. A flotation device according to claim 13 wherein a lower end of the top cone is nested at least partially within an upper end of the bottom cone.

16. A flotation device according to claim 11, wherein the top cone is truncated and includes an opening at its lowermost end.

17. A flotation device according to claim 13, wherein the lowermost end of the bottom cone fits relatively closely around the drive shaft, thereby substantially to impede slurry flow through a region between the lowermost end of the bottom cone and the drive shaft.

18. A flotation device according to claim 1, wherein the agitation means of each of said tanks includes a rotor supported for rotation within a surrounding stator, and operable by means of a central drive shaft extending downwardly into the respective tank.

19. A flotation device according to claim 1, wherein the aeration means of each of said tanks includes an air blower and a fluid conduit for directing air from the blower into the respective agitation means.

20. A flotation device according to claim 19, wherein the fluid conduit of the aeration means includes an axial bore extending through the drive shaft of the respective rotor.

21. A flotation device according to claim 1, wherein each of said tanks is generally in the shape of a right circular cylinder.

22. A flotation device according to claim 1, wherein the bottom outlet of each of said tanks is defined by an opening in the lower half of the tank.

23. A flotation device according to claim 22, wherein the opening defining the bottom outlet of each of said tanks is defined in the respective tank sidewall adjacent the tank floor.

24. A flotation device according to claim 22, wherein the opening defining the bottom outlet of each of said tanks is defined in the respective tank floor adjacent the tank sidewall.

25. A flotation device according to claim 1, including a plurality of downstream tanks connected in series, each configured for optimal treatment of a slurry including a relatively high proportion of relatively coarse or dense components and each having an inlet connected to the bottom outlet of its adjacent upstream tank.

26. A flotation device according to claim 25, wherein all of the downstream tanks are substantially identical, with each tank including a side outlet for withdrawal of relatively lower density components of the slurry from an adjacent upstream tank.

27. A flotation device according to claim 25, wherein a side outlet of each tank directs lower density slurry components to a separate slurry processing unit configured for optimal treatment of relatively fine particles.

28. A flotation device according to claim 25, wherein only the third and subsequent tanks in the series include a side outlet for withdrawal of relatively lower density components of the slurry from the tank.

29. A flotation device according to claim 25, wherein a the plurality of said tanks is arranged in pairs, wherein the level of the base of each successive tank pair is lower than the base of its adjacent upstream pair, such that slurry flows under the influence of gravity from one tank pair to the next.

30. A flotation device according to claim 25, wherein the plurality of tanks is arranged in groups of more than two, wherein the level of the base of each successive tank group is lower than the base of the adjacent upstream group, such that slurry flows under the influence of gravity from one tank group to the next.

31. A flotation device according to claim 29, wherein the outlet from one tank pair to the adjacent downstream tank pair includes a valve to allow discharge of the relatively coarse or dense components of the slurry.

32. A flotation device according to claim 31, wherein the valve is a dart valve.

33. A flotation device according to claim 32, wherein the valve is positioned substantially within the tank adjacent the outlet.

34. A flotation device according to claim 32, wherein the valve is positioned in a conduit extending between adjoining tanks.

35. A flotation device according to claim 1, wherein each tank has a capacity of at least 100 $m^3$.

36. A flotation device according to claim 1, wherein the slurry entering said upstream tank via the feed inlet includes less than around 55% solids.

37. A flotation device according to claim 1, wherein the agitation means of each tank is aligned with the respective feed inlet, such that feed slurry entering the tank flows directly into the agitation means.

38. A method of separate size flotation including the steps of:

providing a flotation device as defined in claim 1;

directing a feed slurry into the flotation device through the feed inlet of the upstream tank;

withdrawing the relatively dense fraction of the slurry through the bottom outlet of the upstream tank and feeding that fraction through the feed inlet of the downstream tank, for reprocessing in the downstream tank; and withdrawing the relatively fine fraction of the slurry through the side outlet for separate size processing independently of the upstream and downstream tanks.

39. A method according to claim 38, wherein after withdrawal through the side outlet, the relatively fine fraction of the slurry is directed into one or more downstream fine particle flotation tanks specifically configured for optimal recovery of relatively fine particles.

40. A method according to claim 39, wherein after withdrawal from the tank and where the fine particles are predominantly gangue shines, they are discarded.

41. A method according to claim 38, wherein after withdrawal from the tank, the relatively coarse or dense components are directed into a separate series of one or more downstream coarse particle flotation tanks.

42. A method according to claim 38, including the steps of providing a sequence of three or more of said tanks, and connecting said tanks in series with the bottom outlet of each tank save for the last being connected to the feed inlet of the tank immediately downstream.

43. A method according to claim 42, including the further step of providing each of said tanks with a respective upper side outlet.

44. A method according to claim 38, including the further step of positioning each downstream tank at a level below the tank immediately upstream thereof, to facilitate gravity feed of slurry through the series of tanks.

45. A method according to claim 38, including the step of adding a flotation reagent to the slurry in the downstream tanks.

46. A method according to claim 38, including the step of diluting the slurry in the downstream tanks.

47. A method according to claim 38, wherein the tanks have a capacity of at least 100 $m^3$.

48. A method according to claim 38, wherein said feed slurry includes less than around 55% solids.

* * * * *